US006031176A

United States Patent [19]

Tanaka

[11] Patent Number: 6,031,176

[45] **Date of Patent: *Feb. 29, 2000**

[54] ELECTRONIC PERCUSSION INSTRUMENT WITH TONE COLOR CONTROLLING SYSTEM USING A PAD SENSOR AND A RIM SENSOR

[75] Inventor: So Tanaka, Shizuoka-ken, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,666

[22] Filed: Jan. 10, 1997

[30] Foreign Application Priority Data

Jan. 17, 1996 [JP] Japan ..... 8-024746

[51] Int. Cl.[7] ..... G10H 1/06

[52] U.S. Cl. ..... 84/735; 84/730

[58] Field of Search ..... 84/730, 735

[56] References Cited

U.S. PATENT DOCUMENTS

| | | | |
|---|---|---|---|
| 4,648,302 | 3/1987 | Bozzio | 84/730 |
| 4,700,602 | 10/1987 | Bozzio . | |
| 4,867,028 | 9/1989 | Jones | 84/735 |
| 5,005,460 | 4/1991 | Suzuki et al. . | |
| 5,056,403 | 10/1991 | Yamashita | 84/743 X |
| 5,247,128 | 9/1993 | Suzuki . | |
| 5,399,801 | 3/1995 | Hasebe et al. . | |

FOREIGN PATENT DOCUMENTS

| | | |
|---|---|---|
| 493995 | 3/1992 | Japan . |
| 695673 | 4/1994 | Japan . |
| 6175651 | 6/1994 | Japan . |

*Primary Examiner*—William M. Shoop, Jr.
*Assistant Examiner*—Jeffrey W. Donels
*Attorney, Agent, or Firm*—Pillsbury Madison & Sutro LLP

[57] ABSTRACT

An electronic percussion instrument includes a pad section and a rim section provided about the pad section. A pad sensor is provided in the pad section to output a signal in response to a force applied to the pad section. A rim sensor is provided in the rim section to detect a signal corresponding to a force applied to the rim section, for example, to detect the presence or the absence of a pressure force applied to the rim section. The electronic percussion instrument includes a tone generation control device that provides unique control over the generation of tones. When a tone is generated based on a signal representative of a beat force applied to the pad sensor, the tone color of the tone is selected based on the presence or the absence of a pressure force applied to the rim sensor.

22 Claims, 2 Drawing Sheets

ELECTRONIC PERCUSSION INSTRUMENT WITH TONE COLOR CONTROLLING SYSTEM USING A PAD SENSOR AND A RIM SENSOR

BACKGROUND OF THE INVENTION

1. Field of the Invention

Embodiments of the present invention relate to an electronic percussion instrument. More particularly, embodiments of the present invention relate to an electronic percussion instrument having a pad section and a rim section provided on the periphery of the pad section.

2. Description of Related Art

Among a variety of electronic percussion instruments, there is a type of electronic percussion instrument that is essentially composed of only a pad for detecting a beating force applied to the pad. Another type has a pad and a rim section provided on the periphery of the pad for detecting the presence or the absence of a beat force applied to the pad. Japanese Laid-open Patent Application HEI 6-175651 describes such an electronic percussion instrument that has a pad and a rim section.

The electronic percussion instrument with the pad and the rim section is capable of performing an ordinary percussion performance when the pad is beaten, and a rim-shot performance when only the rim is beaten. The rim-shot performance generates a tone in a harder tone color than the one generated by the ordinary percussion performance.

In the above-described electronic percussion instrument, the tone color of a tone to be generated is set by an independent tone color setting switch. Once a tone is set for the performance of the electronic percussion instrument, the same pre-set tone is generated throughout the performance until the tone is changed by the tone color setting switch. Therefore, when a performer wants to change the tone color, he may have to stop the performance and operate the tone color setting switch to change the tone color. As a result, the flow of the performance is interrupted, which is undesirable.

SUMMARY OF THE INVENTION

It is an object of the present invention to provide an electronic percussion instrument with which a user can readily change the tone color while he is performing the instrument without stopping or interrupting the performance of the instrument.

In accordance with a first embodiment of the present invention, an electronic percussion instrument comprises a pad section, a rim section and a tone generation control device. The pad section has a pad sensor that outputs a signal in response to a force applied to the pad section. The force may be applied to the pad section by beating the pad section, applying a pressure to the pad section or the like. The rim section is provided on a periphery of the pad section and has a rim sensor that outputs a signal in response to a force applied to the rim section. For example, the force is applied by beating the rim section, applying a pressure to the rim section or the like. The tone generation control device controls the generation of tones so that tones that are generated upon application of a force to the pad section have different tone colors, depending upon whether or not the signal outputted from the rim sensor represents a depressed state in which the rim sensor is depressed.

In accordance with the first embodiment of the present invention, tones are generated in different tone colors depending upon how the pad section and the rim section are operated. In a preferred embodiment, the electronic percussion instrument generates tones in three different tone colors in three different conditions, namely, when only the pad section is beaten, when the pad section and the rim section are beaten generally at the same time, and when the pad section is beaten while the rim section is depressed (which is different from when the rim section is beaten), respectively. In accordance with an embodiment, when only the pad section is beaten, and the rim sensor is not operated and thus does not provide any output, the tone generation control device generates a tone with a first tone color that is representative of an ordinary percussion performance. When the pad section and the rim section are beaten generally at the same time, the rim sensor outputs a signal representing a beating condition in which the rim sensor is beaten. As a result, the tone generation control device generates a tone with a second tone color that is representative of a rim-shot performance and different from the first tone color. When the pad section is beaten while the rim section is depressed, the rim sensor outputs a signal representing a depression condition in which the rim section is depressed for a relatively long time, so the tone generation control device generates a tone with a third tone color that is different from the first tone color or from the second tone color. In this manner, tone colors are changed depending upon whether or not a force is applied to the rim section and what type of force is applied to the rim section when the pad section is beaten. As a consequence, the performer can readily change the tone color while he is performing the instrument.

In accordance with a second embodiment of the present invention, an electronic percussion instrument comprises a pad section, a rim section provided on a periphery of the pad and a tone generation control device. The pad section has a pad sensor that outputs a signal in response to a force applied to the pad section. In one embodiment, the force may be applied by beating the pad section. The rim section has a rim sensor that outputs a signal in response to a force applied to the rim section. In one embodiment, the force is applied by beating the rim section or by depressing the rim section. The tone generation control device controls the generation of tones depending upon whether a tone is generated in synchronism with a tone generation event provided by the pad section or by the rim section. In another embodiment, the electronic percussion instrument generates tones having different tone colors depending upon which one of the pad section and the rim section is beaten first. In a preferred embodiment, when a tone is generated in synchronism with a beat event provided by the pad section, the tone has a tone color corresponding to a state of the signal provided by the rim sensor. On the other hand, when a tone is generated in synchronism with a beat event provided by the rim section, the tone has a tone color corresponding to a state of the signal provided by the pad sensor.

In accordance with an embodiment, when the pad section alone is beaten, and the rim sensor does not provide any output, the tone generation control device generates a tone with a first tone color of an ordinary percussion performance. When the pad section and the rim section are beaten generally at the same time, but with the pad section beaten slightly earlier than the rim section, a tone is generated with a tone color according to the state of a signal generated by the rim sensor. For example, when a signal from the rim sensor represents a condition in which the rim section is depressed, a tone is generated with a second tone color that is different from the first tone color of the ordinary percussion performance. When the pad section and the rim section are beaten generally at the same time, but with the rim section beaten slightly earlier than the pad section, a tone is generated with a tone color according to the state of a signal generated by the pad sensor. For example, when a signal from the pad is greater than a predetermined value, a determination is made that the pad section and the rim section are beaten simultaneously, and a tone is generated with a third tone color of an open-rim-shot performance. When a signal representative of a beat applied to the pad sensor is smaller than the predetermined value, a determination is made that only the rim section is beaten, and a tone is generated with a fourth tone color of a closed-rim-shot performance. Alternatively, when a signal representative of a beat applied to the pad sensor is smaller than the predetermined value, a determination is made that only the rim section is depressed, and a damper process is performed. Accordingly, even when only the pad section is beaten, tones with different tone colors can be generated depending upon whether the rim section is depressed or not. As a result, the performer can readily change tone colors while performing the instrument.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

DESCRIPTION OF PREFERRED EMBODIMENTS

Embodiments of the present invention will be described below with reference to the accompanying drawings.

Figure 1:
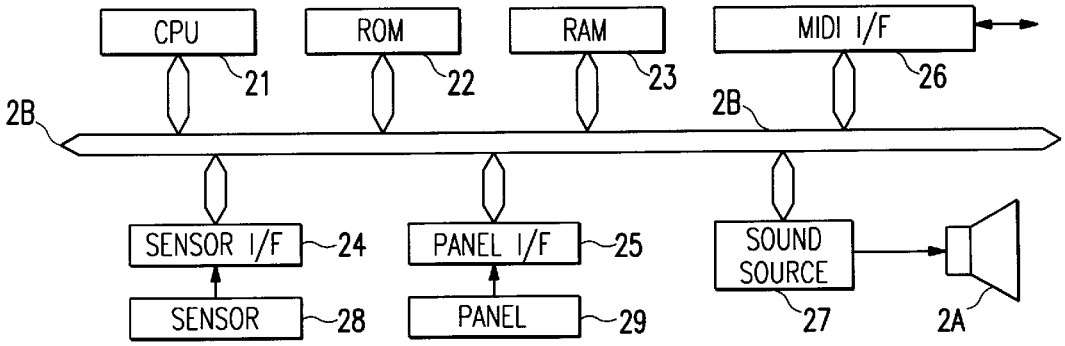
FIG. 1 shows a block diagram of hardware components of an electronic percussion instrument in accordance with an embodiment of the present invention.
Figure 2:
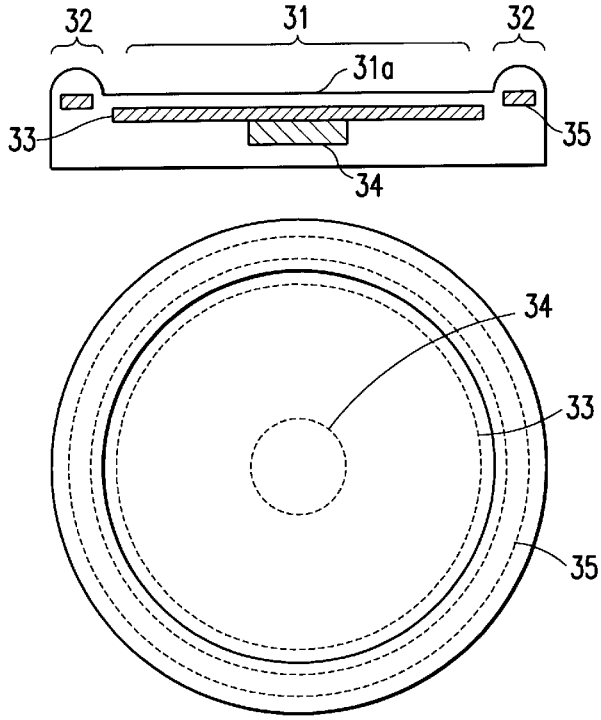
FIG. 2 schematically shows a structure of a pad section and a rim section of an electronic percussion instrument in accordance with an embodiment of the present invention.

FIG. 1 shows a block diagram of hardware of an electronic percussion instrument in accordance with an embodiment of the present invention. FIG. 2 schematically shows a pad section 31 and a rim section 32 of the electronic percussion instrument.

The electronic percussion instrument executes a variety of processes controlled by a microcomputer that includes, among other things, a microprocessor unit (CPU) 21, a program memory (ROM) 22 and a data and working RAM 23.

The CPU 21 controls the operation of the electronic percussion instrument.

The program memory 22 stores a variety of programs, instructions and data to be executed by the CPU 21. In the illustrated embodiment, the program memory 22 is formed from a read only memory (ROM). The programs, instructions and data to be executed by the CPU 21 may be provided by any one of appropriate machine readable medias, such as, a read only memory (ROM), a random access memory (RAM), a hard disc drive (HDD), a compact disc read only memory (CD ROM) and the like or a combination thereof.

The data and working RAM 23 temporarily stores a variety of data that are generated when the CPU 21 executes the programs. Predetermined address regions in the data and working RAM 23 are allocated to the data and used as registers and flags.

The microcomputer connects to a sensor interface (I/F) 24, a panel interface (I/F) 25, a MIDI interface (I/F) 26 and a sound source circuit 27 via a data and address bus 2B.

The sensor interface 24 receives detection signals provided by a sensor 28, and converts the detection signals into signals that can be processed by the microcomputer. In an embodiment, the sensor 28 includes a pad sensor 34 and a rim sensor 35 (see FIG. 2) mounted on the electronic percussion instrument.

Figure 3:
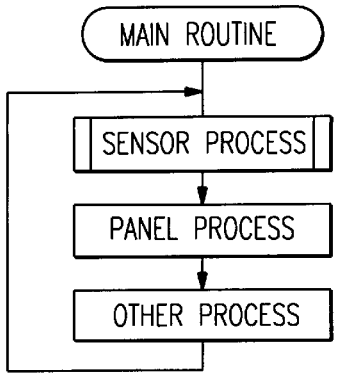
FIG. 3 shows a main routine process that is executed by a microcomputer.

As shown in FIG. 2, the electronic percussion instrument, in accordance with an embodiment of the present invention, is formed in the shape of a shallow dish-like circular plate having a pad section 31 and a circular rim section 32 extending along the periphery of the pad section 31. The pad section 31 has a generally flat top surface 31*a* that serves as a beating surface. The pad sensor 34 and the rim sensor 35 are internally mounted in the pad section 31 and the rim section 32, respectively, as shown in FIG. 3. In an embodiment, the pad section 31 and the rim section 32 are entirely covered by a relatively resilient material, such as rubber, synthetic rubber, plastic and the like.

The pad section 31 includes a pad plate 33 below the top surface 31*a* of the pad section 31. The pad plate 33 is made of an appropriate vibrating material, and vibrates as the pad section 31 is beaten. In the illustrated embodiment, the pad plate 33 is formed from a circular iron plate. However, other materials such as plastics, ceramics, composites, wood, other metals or the like may be used. The pad sensor 34 is coupled to the pad plate 33 for detecting vibrations of the pad plate 33. The rim sensor 35 detects the presence or the absence of a force, such as a beating force or a pressure, applied to the rim section 32.

In a preferred embodiment, the pad sensor 34 is formed from a piezoelectric element and outputs a signal representative of a force applied to the pad section 31. Typically, the pad section 31 is beaten by the hand or other beating members, such as, for example, drum sticks, and the pad sensor 34 outputs a signal representative of the beating force applied to the pad section 31. The rim sensor 35 is formed from a ring-shaped sheet (film) switch and outputs a signal representative of whether or not a force is applied to the rim section 32. For example, when the rim section 35 is beaten or depressed by the performer's hands or other beating members, such as, for example drum sticks, the rim sensor 35 outputs a signal representing that the rim section 35 is being beaten or depressed.

The pad section 31 and the rim section 32 are formed from many more components than those described above. However, the detailed description of the other components is not needed by those of ordinary skill in the at, and therefore is omitted herein.

An operation panel 29 includes a variety of operation members (not shown) for selecting, setting and controlling the tone color, loudness and sound effects of tones to be generated. The panel interface 25 is responsive to the operation members of the operation panel 29, and outputs operation data representative of operational conditions of the respective operation members.

The MIDI interface 26 handles transfer of MIDI data between the electronic percussion instrument and external equipment connected to the electronic percussion instrument.

A sound source circuit 27 is capable of simultaneously generating musical sound signals in a plurality of channels, and generates musical sound signals based on MIDI date that is provided through the data and address bus 2B.

Any one of the publicly known musical sound signal generation systems may be used for the sound source circuit 27. For example, the publicly known musical sound signal generation systems include a memory read-out system, an FM system, an AM system or the like. In the memory read-out system, musical sound waveshape sample value data stored in a waveshape memory are successively read out according to address data that changes in response to the pitch of a tone to be generated. In the FM system, musical sound waveshape sample value data are generated by frequency-modulating a plurality of waveshapes, using the above-described address data as phase angle parameter data. In the AM system, musical sound waveshape sample value data are generated by executing an amplification modulation calculation. The musical sound signal generated by the sound source circuit 27 is outputted through a sound system 2A that is typically formed from an amplifier and a loudspeaker.

In the above-described embodiment, the electronic percussion instrument is provided as an independent unit. However, in an alternative embodiment, an electronic percussion instrument may be connected to an external sound generation apparatus so that tones representative of percussion forces and pressure forces applied to the electronic percussion instrument are generated by the external sound generation apparatus. Alternatively, an electronic percussion instrument may be connected to a personal computer so that the tone generation for the electronic percussion instrument is additionally or independently controlled by the personal computer. Moreover, in a further embodiment, an electronic percussion instrument may be mounted on another electronic musical instrument, such as, for example, a keyboard apparatus.

A main routine executed by the microcomputer shown in FIG. 1 will be described with reference to a flow chart shown in FIG. 3.

First, the microcomputer executes a sensor process in response to sensor outputs generated by the pad sensor 34 and the rim sensor 35. The sensor process will be described in more detail below. Next, the microcomputer executes a panel process corresponding to operations of the operation members of the operation panel 29. In the panel process, when a tone color is selected by operating a tone color selection switch (not shown) in the operation panel 29, note numbers corresponding to the selected tone color are stored in a first pad tone color register Pa, a second pad tone color register Pb, a first rim-shot tone color register Ro and a second rim-shot tone color register Rc, respectively. When the tone color selection switch is not operated, pre-set initial values are stored in the respective registers. The microcomputer executes other processes, such as, for example, processing MIDI data supplied through the MIDI interface 26.

Figure 4:
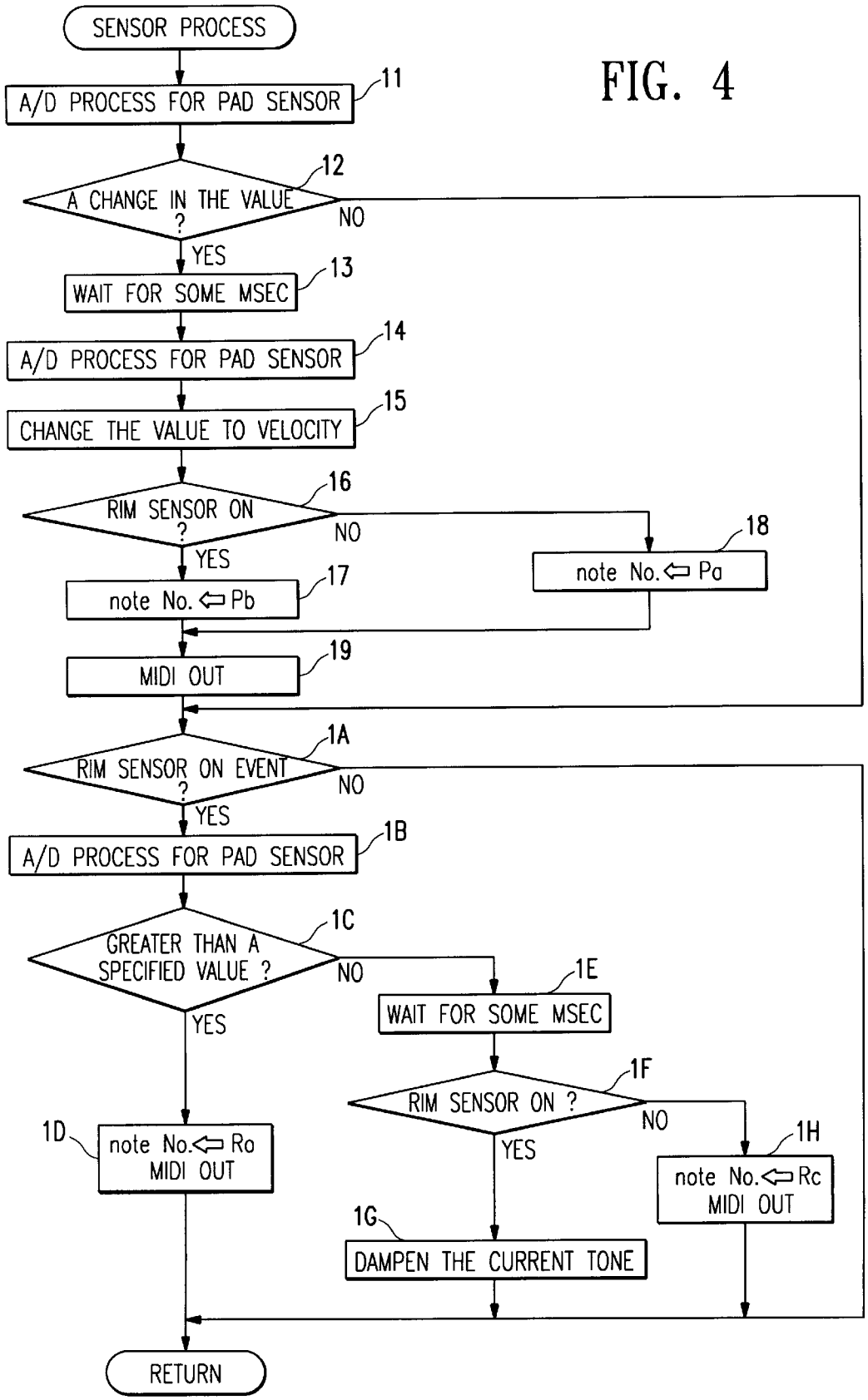
FIG. 4 shows a detailed flow chart of the sensor process shown in FIG. 3.

FIG. 4 shows a detailed flow chart of the sensor process of FIG. 3.

In step 11, an analog signal transmitted from the pad sensor 34 through the sensor interface 24 is analog-to-digital (A/D) converted into a digital signal.

In step 12, a determination is made whether or not the pad section 31 is beaten. To make the determination in step 12, in a preferred embodiment, a value of the digital signal currently obtained in step 11 is compared with a value of a previously obtained digital signal to determine if there is a change in the value of the digital signal obtained in step 11. When there is a change in the value (YES), the process proceeds to step 13. When there is no change in the value, the process proceeds to step 1A.

As described above, when the pad section 31 is beaten, the determination YES is made in step 12. However, at the moment when the determination is made, the application of the beating force is still in an initial stage and it has not reached the final value. Therefore, in step 13, the process waits for several msec until the beating force reaches the final value. In step 14, the analog signal transmitted from the pad sensor 34 through the sensor interface 24 is analog-to-digital (A/D) converted again into a digital signal, and the digital signal is converted to a velocity value in step 15.

In step 16, a determination is made whether a signal from the rim sensor 35 is transmitted through the sensor interface 24. In other words, a determination is made whether the rim sensor 35 is turned on or off. When the rim sensor 35 is turned on (YES), the process proceeds to step 17, and when the rim sensor 35 is turned off, the process proceeds to step 18.

In step 17, the note number stored in the first pad tone color register Pb is stored in a note number register note No. In step 18, the note number stored in the second pad tone color register Pa is stored in the note number register note No. In step 19, a key-on event, the velocity value obtained in the above-described step 15, and the note number stored in the note number register note No. are outputted to the sound source 27 as MIDI data.

It is noted that a determination YES is made in step 16 when the rim section 32 has been depressed by the performer's hand, drum stick or other members before the pad section 31 is beaten. On the other hand, a determination NO is made when the rim section 32 has not been depressed by anything before the pad section 31 is beaten. Therefore, the tone color of a tone to be generated by beating the pad section 31 can be changed depending on whether or not the rim section 32 has been depressed before the pad section 31 is beaten. This results in an increased variation in the tone color of generated tones.

In step 1A, a determination is made whether an on-event is outputted from the rim sensor 35 as a result of percussion or depression applied to the rim section 32. When an on-event is outputted (YES), the process proceeds to step 1B. When there is no on-event (NO) outputted from the rim section 32, the process returns to the main routine.

In step 1B, an analog signal outputted from the pad sensor 34 is analog-to-digital (A/D) converted to a digital signal. In an embodiment, a wait process, similar to the process in step 13, may be executed before the process in step 1B. In step 1C, a determination is made whether or not the digital signal is greater than a specified value. When the digital signal is greater than the specified value (YES), the process proceeds to the next step 1D, and when it is not (NO), the process proceeds to step 1E.

It is noted that when the open-rim-shot performance is performed in which the pad section 31 and the rim section 32 are beaten or hit generally at the same time, the digital signal that is converted from the analog signal provided by the pad sensor 34 has a value greater than the predetermined value. As a result, in step 1D, the note number currently stored in the first rim-shot tone color register Ro is stored in the note number register note No. Then, the note number currently stored in the key-on and note-number register note No. is outputted to the sound source 27 as MIDI data, and the process returns to the main routine. In this case, after step 1B, a velocity value for the digital signal may be extracted in a similar manner as executed in step 15.

It is noted that, when the closed-rim-shot performance is performed in which only the rim section 32 is beaten (hit), or the rim section 32 is depressed, the digital signal that is converted from the analog signal provided by the pad sensor 34 has a value smaller than the specified value. When the rim section 32 is beaten in the closed-rim-shot performance, the rim sensor 35 changes to an off-state after a predetermined period of time (for example, a few msec) has passed. However, when the rim section 32 is continuously depressed, the rim sensor 35 remains in an on-state even after the predetermined period of time has passed. Accordingly, after the determination is made in step 1C, the process waits for the predetermined period in step 1E in order to allow the predetermined period of time to pass, and a determination is made in step 1F whether the rim sensor 35 is in the on-state. When the determination represents the on-state (YES), which means that the rim section 32 is continuously depressed, the process proceeds to step 1G wherein the currently generated tone is damped and then returns to the main routine. In other words, when the rim section 32 is depressed, the characteristic process for the percussion instruments, in which the currently generated tone is damped, is executed. When the determination in step 1F represents the off-state of the rim sensor 35 (NO), the closed-rim-shot performance is performed in which only the rim section 32 is beaten or hit. Accordingly, the note number currently stored in the second rim-shot tone color register Rc is stored in the note number register note No., in step 1H. Then, the note number currently stored in the Key-on and note number register note No. is outputted to the sound source as MIDI data, and the process returns to the main routine.

In the above-described embodiments, the rim sensor 34 is formed from a ring-shaped sheet (film) switch that outputs on/off signals, and a determination is made in step 1A as to whether there is an on-event provided by the rim sensor. In an alternative embodiment, the rim sensor 34 may be formed from a piezoelectric element that is similar to the pad sensor 34. In such a case, a determination may be made as to whether there is a change in the output value, in the same manner as step 11 or step 12. Furthermore, in step 16 in accordance with the above-described embodiment, two different tone colors are selectively outputted in response to whether the rim sensor 35 is in the on-state or the off-state. However, when the rim sensor 35 is formed from a piezoelectric element, three or more tone colors may be provided and an appropriate tone color may be selected from the given tone colors in response to an output value from the rim sensor 35. Alternatively, a determination may be made between step 16 and step 17 as to whether an output value from the rim sensor 35 is greater than a specified value, and different tone colors are generated in response to the determination. Accordingly, the variety of tone colors to be selected is increased.

In the above-described embodiments, different tone colors are generated depending upon whether the open rim-shot performance or the closed rim-shot performance is performed. However, when the determination in step 1C is NO, the damp process in step 1F may be immediately executed so that a tone corresponding to the closed-rim-shot is not generated.

In the above-described embodiments, the rim sensor is formed from a ring-shaped no-end switch. In alternative embodiments, the rim sensor may be divided into a plurality of segments, such as, for example, two semi-circle segments, three arc segments and the like, and tone colors may be differentiated depending upon which one of the rim segments is depressed or beaten. For example, the ring-shaped sheet switch 35 shown in FIG. 2 may be divided into two halves to provide two semicircular sheet switches. In this case, determinations are made immediately before steps 17, 1D and 1H as to which one of the switches is beaten or depressed, and note numbers stored in the tone color register responsive to the determination are stored in the note number register note No. As a result, the variation in tone colors can be increased. Furthermore, the rim sensor 35 may be divided into a plurality of segments, and each of the segments may be formed from a piezoelectric element. In this case, a different tone color may be generated in response to an output from each of the segments in a similar manner as described above. As a result, the number of selectable tone colors can be further increased.

In one of the above-described embodiments, the rim sensor is divided, and different tones having different tone colors are generated depending upon which one of the rim sensor segments is beaten or depressed. However, a foot pedal or the like may be provided instead of the rim sensor, and determinations are made immediately before step 17, 1D and 1H as to whether the foot pedal is in the on-state or in the off-state so that different tone colors are provided depending on the determinations. Alternatively, different tone colors may be selected based on the degree to which the foot pedal is depressed.

When the rim sensor 35 is divided into a plurality of segments, only the corresponding plurality of different switch states may be provided. However, the ring-shaped sheet switch may be formed from a ring-shaped metal plate and piezoelectric elements attached to the ring-shaped metal plate to increase the number of different switch states. It is noted that any one of appropriate metal materials may be used for the ring-shaped plate, such as, for example, iron, aluminum alloy, and the like. In an embodiment, piezoelectric elements are attached to opposite ends of the ring-shaped metal plate to generate a signal in response to a percussion force or a pressure force applied to the rim section 32. In response to the signal, a location of the percussion force or the pressure force is detected and a different tone color is generated based upon the location. In an alternative embodiment, piezoelectric elements are attached to an upper surface and a lower surface of the ring-shaped metal plate. As a result, locations of a percussion force or a depression force applied between the upper and lower piezoelectric elements can be detected. In a further embodiment, three piezoelectric elements are provided on the ring-shaped metal plate to locate a percussion force or a depression force applied to the ring-shaped metal plate with respect to the entire area of the ring-shaped metal plate, and different tone colors are generated depending upon the location of the force applied to the rim section.

In the above-described embodiments, tone colors are changed. However, a variety of other musical characteristics other than the tone color, such as, for example, loudness, pitch and the like, may be changed and controlled.

In accordance with embodiments of the present invention, a performer of an electronic percussion instrument can readily change tone colors while he is playing the instrument without interrupting the performance.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electronic percussion instrument comprising:

a pad section having a pad sensor that outputs a signal in response to a force applied to the pad section;

a rim section provided on a periphery of the pad section and having a ring-shaped sheet switch that outputs a signal in response to a force applied to the rim section;

a selector that selects two tone colors, for a tone to be generated, from among a plurality of tone colors as a first tone color and a second tone color; and a tone generation control device that generates a tone having the first tone color in response to the signal outputted from the pad sensor when the signal is not provided from the ring-shaped sheet switch and generates a tone having the second tone color different from the first tone color in response to the signal outputted from the pad sensor when the signal is provided from the ring-shaped sheet switch.

2. An electronic percussion instrument as defined in claim 1, wherein the tone generation control device dampens the tone when a signal from the ring-shaped sheet switch continues longer than a specified period of time while the tone having the first or second tone color is being generated.

3. An electronic percussion instrument comprising:

a pad section having a pad sensor that outputs a signal in response to a force applied to the pad section;

a rim section provided on a periphery of the pad section and having a rim sensor that outputs a signal in response to a force applied to the rim section, wherein the rim sensor is formed from a piezoelectric element device for generating a signal representative of a force applied to the rim section;

a selector that selects at least two tone colors, for a tone to be generated, from among a plurality of tone colors; and a tone generation control device that detects a change in the signal generated by the rim sensor and generates a tone having one of the selected tone colors depending on the detected change.

4. An electronic percussion instrument comprising:

a pad section having a pad sensor that outputs a signal in response to a force applied to the pad section;

a rim section provided on a periphery of the pad section and having a rim sensor that outputs a signal in response to a force applied to the rim section, wherein the rim sensor generates a plurality of different outputs in response to forces applied to corresponding locations along the rim section;

a selector that selects two tone colors, for a tone to be generated, from among a plurality of tone colors as a first tone and a second tone color; and a tone generation control device that generates a tone having the first tone color in response to the signal outputted from the pad sensor when the signal is not provided from the rim sensor and generates a tone having the second tone color different from the first tone color in response to the signal outputted from the pad sensor when the signal is provided from the rim sensor, wherein the tone generation control device includes a device for storing data for the plurality of tone colors that upon application of a force to one of the plurality of different locations on the rim section, the tone generation control generates a tone having one of the plurality of tone colors associated with the location where the force is applied.

5. An electronic percussion instrument comprising:

a pad section having a pad sensor that outputs a signal in response to a force applied to the pad section;

a rim section provided on a periphery of the pad section and having a rim sensor that outputs a signal in response to a force applied to the rim section, wherein the rim sensor includes a plurality of sensor segments provided in the rim section;

a selector that selects two tone colors, for a tone to be generated, from among a plurality of tone colors as a first tone and a second tone color; and a tone generation control device that generates a tone having the first tone color in response to the signal outputted from the pad sensor when the signal is not provided from the rim sensor and generates a tone having the second tone color different from the first tone color in response to the signal outputted from the pad sensor when the signal is provided from the rim sensor, wherein the tone generation control device includes a device for storing data for the plurality of tone colors that upon application of a force to one of the plurality of sensor segments, the tone generation control device generates a tone having one of the plurality of tone colors associated with the sensor segment to which the force is applied.

6. A method of operating an electronic percussion instrument, the method comprising the steps of:

using a pad section having a pad sensor that outputs a signal in response to a force applied to the pad section;

using a rim section on a periphery of the pad section and having a ring-shaped sheet switch that outputs a signal in response to a force applied to the rim section;

selecting two tone colors, for a tone to be generated, from among a plurality of tone colors as a first tone color and a second tone color;

generating a tone having the first tone color in response to the signal outputted from the pad sensor when the signal is not provided from the ring-shaped sheet switch; and generating a tone having the second tone color different from the tone having the first tone color in response to the signal outputted from the pad sensor when the signal is provided from the ring-shaped sheet switch.

7. A method of operating an electronic percussion instrument as defined in claim 6, wherein the tone is dampened when a signal from the ring-shaped sheet switch continues longer than a specified period of time while the tone having the first or second tone color is being generated.

8. A method of operating an electronic percussion instrument, the method comprising the steps of:

using a pad section having a pad sensor that outputs a signal in response to a force applied to the pad section;

using a rim section on a periphery of the pad section and having a rim sensor that outputs a signal in response to a force applied to the rim section;

selecting at least two tone colors, for a tone to be generated, from among a plurality of tone colors; and detecting a change in the signal generated by the rim sensor and generating a tone having one of the selected tone colors depending on the detected changed.

9. A machine readable media containing instructions for causing an electronic percussion instrument to perform a method of generating tones, the electronic percussion instrument including a pad section having a pad sensor that outputs a signal in response to a force applied to the pad section and a rim section provided on a periphery of the pad section and having a ring-shaped sheet switch that outputs a signal in response to a force applied to the rim section, the method comprising the steps of:

selecting two tone colors, for a tone to be generated, from among a plurality of tone colors as a first tone color and a second tone color;

generating a tone having the first tone color in response to the signal outputted from the pad sensor when the signal is not provided from the ring-shaped sheet switch; and generating a tone having the second tone color different from the tone having the first tone color in response to the signal outputted from the pad sensor when the signal is provided from the ring-shaped sheet switch.

10. A machine readable media as defined in claim 9, wherein the method further comprises the step of dampening the tone having the second tone color when the signal from the ring-shaped sheet switch continues longer than a specified period of time while the tone having the first or second tone color is being generated.

11. A machine readable media containing instructions for causing an electronic percussion instrument to perform a method of generating tones, the electronic percussion instrument including a pad section having a pad sensor that outputs a signal in response to a force applied to the pad section and a rim section provided on a periphery of the pad section and having a rim sensor that outputs a signal in response to a force applied to the rim section, the method comprising the steps of:

selecting two tone colors, for a tone to be generated, from among a plurality of tone colors as a first tone color and a second tone color; and detecting a change in the signal generated by the rim sensor and generating a tone having one of the selected tone colors depending on the detected change.

12. An electronic percussion instrument comprising:

a pad section having a pad sensor that outputs a signal in response to a force applied to the pad section;

a rim section provided on a periphery of the pad having a ring-shaped sheet switch that outputs a signal in response to a force applied to the rim section;

a selector that selects two tone colors, for a tone to be generated, from among a plurality of tone colors as a first tone color and a second tone color; and a tone generation control device that generates a tone having the first tone color corresponding to a state of a force applied at the rim section when the tone is generated in synchronism with a beat event at the pad section, and generates a tone having the second tone color corresponding to a state of a force applied at the pad section when the tone is generated in synchronism with a beat event at the rim section.

13. An electronic percussion instrument as defined in claim 12, wherein the tone having the second tone color is indicative of an open-rim-shot when the force applied at the pad section is greater than a specified value.

14. An electronic percussion instrument as defined in claim 12, wherein the tone having the second tone color is indicative of a closed-rim-shot when the force applied at the pad section is smaller than a specified value.

15. A method of operating an electronic percussion instrument, the method comprising the steps of:

using a pad section having a pad sensor that outputs a signal in response to a force applied to the pad section;

using a rim section on a periphery of the pad having a ring-shaped sheet switch that outputs a signal in response to a force applied to the rim section;

selecting two tone colors, for a tone to be generated, from among a plurality of tone colors as a first tone color and a second tone color; and generating a tone having the first tone color corresponding to a state of a force applied at the rim section when the tone is generated in synchronism with a beat event at the pad section; and generating a tone having the second tone color corresponding to a state of a force applied at the pad section when the tone is generated in synchronism with a beat event at the rim section.

16. A method of operating an electronic percussion instrument as defined in claim 15, wherein the tone having the second tone color is indicative of an open-rim-shot when the force applied at the pad section is greater than a specified value.

17. A method of operating an electronic percussion instrument as defined in claim 15, wherein the tone having the second tone color is indicative of a closed-rim-shot when the force applied at the pad section is smaller than a specified value.

18. A method of operating an electronic percussion instrument as defined in claim 15, wherein the tone having the second tone color is dampened when the force applied at the pad section is smaller than a specified value.

19. A machine readable media containing instructions for causing an electronic percussion instrument to perform a method of generating tones, the electronic percussion instrument including a pad section having a pad sensor that outputs a signal in response to a force applied to the pad section and a rim section provided on a periphery of the pad section and having a ring-shaped sheet switch that outputs a signal in response to a force applied to the rim section, the method comprising the steps of:

selecting two tone colors, for a tone to be generated, from among a plurality of tone colors as a first tone color and a second tone color;

generating a tone in a tone having the first tone color corresponding to a state of a force applied at the rim section when the tone is generated in synchronism with a beat event at the pad section; and generating a tone in a tone having the second tone color corresponding to a state of a force applied at the pad section when the tone is generated in synchronism with a beat event at the rim section.

20. A machine readable media as defined in claim 19, wherein the tone having the second tone color is indicative of an open-rim-shot when the force applied at the pad section is greater than a specified value.

21. A machine readable media as defined in claim 19, wherein the tone having the second tone color is indicative of a closed-rim-shot when the force applied at the pad section is smaller than a specified value.

22. A machine readable media as defined in claim 19, wherein the tone having the second tone color is dampened when the force applied at the pad section is smaller than a specified value.

* * * * *